US008011633B2

(12) United States Patent
Huang

(10) Patent No.: US 8,011,633 B2
(45) Date of Patent: Sep. 6, 2011

(54) HOOK STRUCTURE

(76) Inventor: Meng-Feng Huang, Shengang Township, Changhua County (TW)

( * ) Notice: Subject to any disclaimer, the term of this patent is extended or adjusted under 35 U.S.C. 154(b) by 0 days.

(21) Appl. No.: 12/071,167

(22) Filed: Feb. 15, 2008

(65) Prior Publication Data

US 2010/0320345 A1 Dec. 23, 2010

(51) Int. Cl.
*F16B 45/00* (2006.01)

(52) U.S. Cl. ..... 248/308; 248/292.13; 248/299.1

(58) Field of Classification Search ..... 248/308, 248/304, 305, 306, 307, 291.1, 292.11, 292.13, 248/299.1
See application file for complete search history.

(56) References Cited

U.S. PATENT DOCUMENTS

| | | | | | |
|---|---|---|---|---|---|
| 1,200,736 | A * | 10/1916 | Laganke | 248/294.1 |
| 2,071,257 | A * | 2/1937 | Hansen | 248/294.1 |
| 4,051,953 | A * | 10/1977 | Shoaf | 211/119.1 |
| 7,118,082 | B2 * | 10/2006 | Brnjac | 248/308 |
| 7,681,851 | B1 * | 3/2010 | Osterholt et al. | 248/308 |
| 7,828,256 | B2 * | 11/2010 | Speggiorin | 248/187.1 |
| 2006/0054761 | A1 * | 3/2006 | Marler et al. | 248/304 |
| 2006/0071137 | A1 * | 4/2006 | Livingstone | 248/308 |
| 2006/0180190 | A1 * | 8/2006 | Ju | 135/120.3 |
| 2009/0108160 | A1 * | 4/2009 | Kluge et al. | 248/308 |

* cited by examiner

*Primary Examiner* — Ramon Ramirez
(74) *Attorney, Agent, or Firm* — Leong C. Lei

(57) ABSTRACT

A hook structure includes a base and a movable hook which is fixed on the base and is provided with a hook board and a hook board seat that are mutually assembled. An elastic member is provided between the hook board and the hook board seat. By the elastic member, when the hook is collided by an external force, the elastic member will operate the hook board to be ejected back, allowing the present invention to be provided with an advantage of a hidden-type and collision-proofed hook.

8 Claims, 15 Drawing Sheets

HOOK STRUCTURE

BACKGROUND OF THE INVENTION a) Field of the Invention

The present invention relates to a hook structure, and more particularly to a hidden-type hook structure.

b) Description of the Prior Art

As in an ordinary family, there is usually a requirement for hanging objects, such as hanging clothes or bags; therefore, hooks have been used very generally in the existing family. Referring to FIG. 1, it shows a perspective view of a conventional hook. A hook 1 is provided with a base 11 and a hook body 12, wherein the base 11 is usually fixed on a wall with glue or a nail, and the hook body 12, which is connected to the base 11, provides for hanging the object, thereby satisfying the requirement of hanging the objects.

However, in using the aforementioned conventional hook 1, following problems and shortcomings actually exist that improvement is needed:

1. The hook body 12 of the conventional hook 1 is connected to the base 11, and the hook body 12 is usually integrally formed or assembled with the base 11. However, whether being the assembly-type or the integrally formed type, the hook body 12 will be protruded on the wall. Therefore, when a person collides with the hook 1, the hook body 12 of the hook 1 will usually be broken or even fractured, resulting in that the hook 1 cannot be used any more, and causing an inconvenience.
2. When installing the conventional hook 1, a ruler or a piece of paper should be used to mark a fixing position first, and then the hook 1 is installed according to the mark of fixing position. Therefore, two actions are needed to accomplish the installation, resulting in that a laboring time will be wasted in installing the hook 1 and the installation will be inconvenient.

Accordingly, how to solve the aforementioned problems and shortcomings of the prior art, is a technological issue of research and development for improvement by the present inventor and related vendors.

SUMMARY OF THE INVENTION

The primary object of the present invention is to provide a hook structure which includes a base and a movable hook, wherein the base is provided with a fixing part, the movable hook is fixed at the fixing part of the base and is provided with a hook board and a hook board seat that are mutually assembled, and an elastic member is provided between the hook board and the hook board seat and can be an elastic board or a spring, such that when the movable hook is collided, the hook board can be ejected back to be attached to the base by an action of the elastic member. By the aforementioned technology, the problem of the conventional hook that it will be easily damaged by being collided can be solved, thereby achieving practical advancement of a hidden-type hook.

Another object of the present invention is provided a hook structure, wherein the hook board seat can be further assembled with a fixing member, two sides of the hook board seat are provided respectively with a guiding edge, and two sides of the fixing member are provided respectively with a guiding slot, with each guiding edge of the hook board seat being mutually assembled with each guiding slot of the fixing member. When the hook is to be installed, the fixing member is fixed on a wall by a screwing element, which needs only one action to accomplish the installation of the hook. By the aforementioned technology, the problem of the conventional hook that the laboring time will be wasted can be solved, thereby achieving the practical advancement of easy installation.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
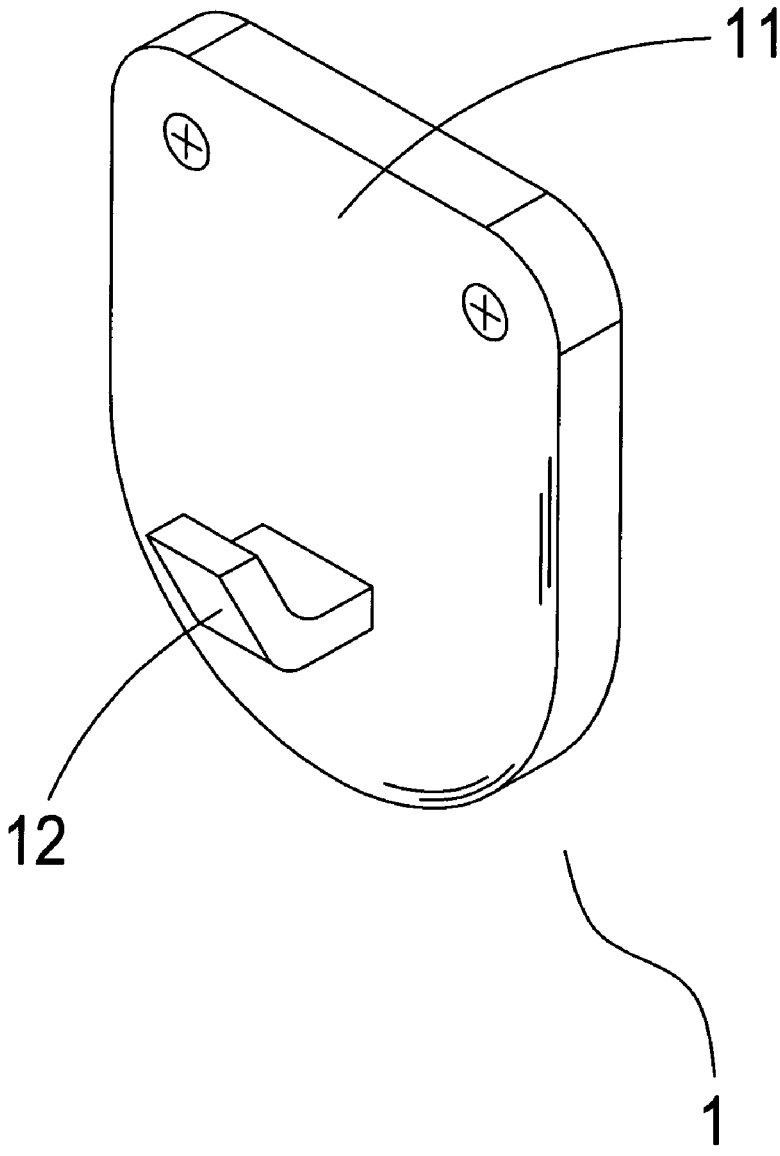
FIG. 1 Prior Art
FIG. 1 shows a perspective view of a conventional hook structure.
Figure 2:
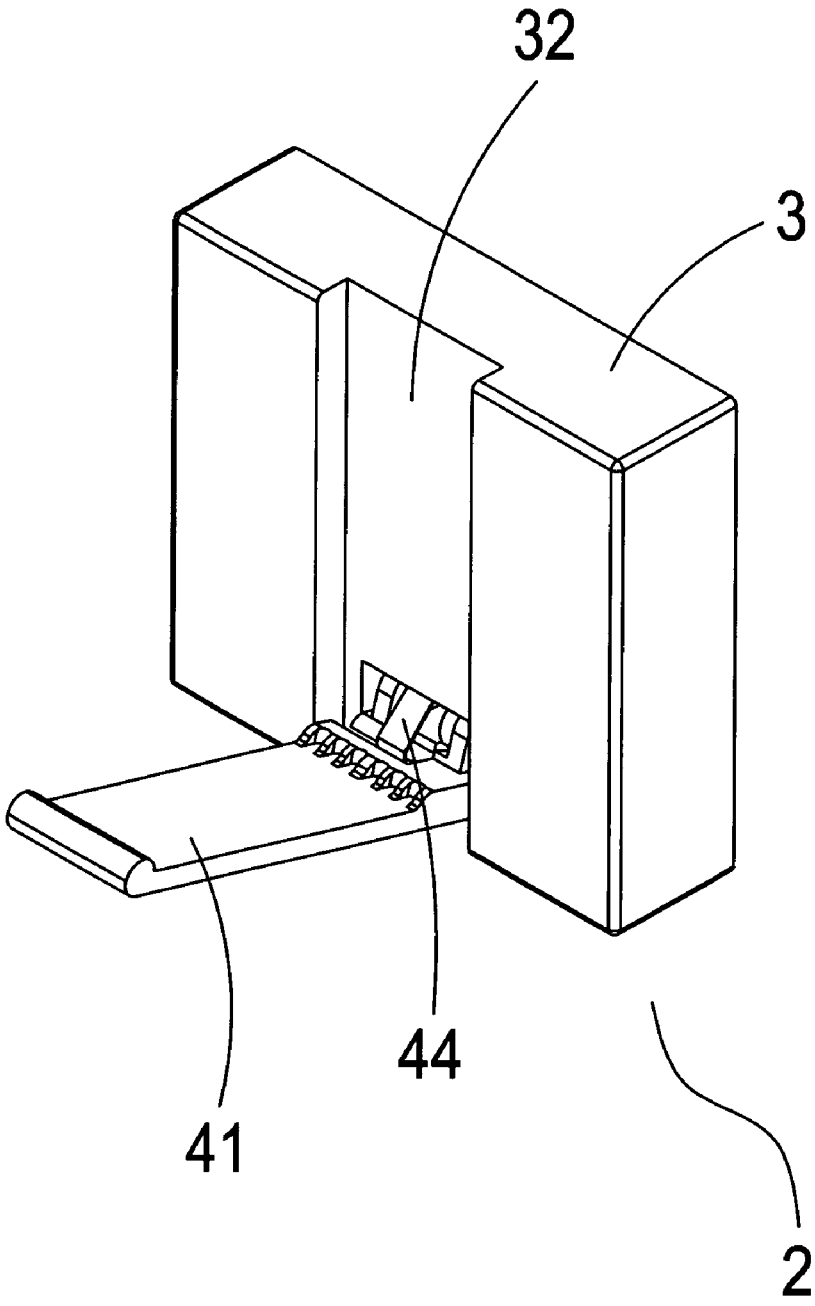
FIG. 2 shows a first perspective view of a preferred embodiment of the present invention.
Figure 3:
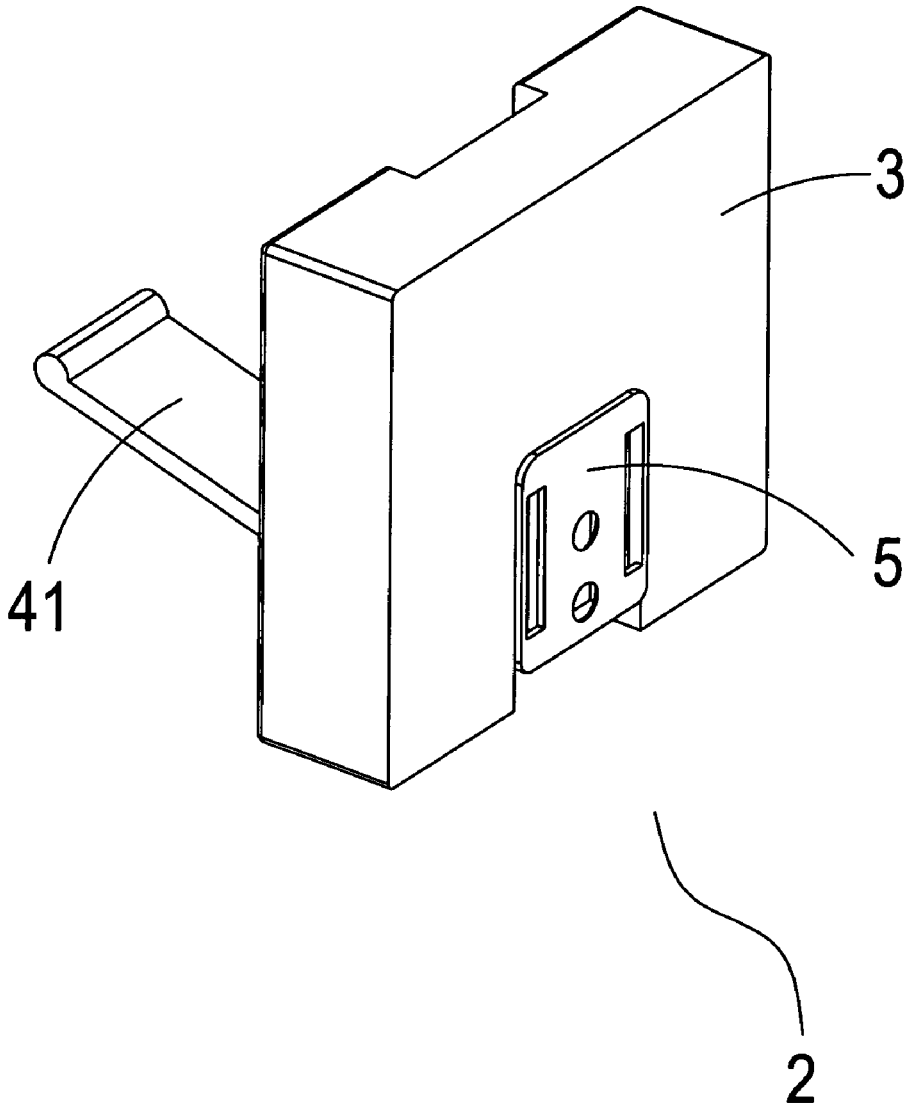
FIG. 3 shows a second perspective view of a preferred embodiment of the present invention.

Referring to FIGS. 2 to 5, it shows a first perspective view, a second perspective view, an exploded view, and a cutaway view, of a preferred embodiment of the present invention. A hook 2 of the present invention comprises a base 3 which is provided with a fixing part 31 and a hook board slot 32; a movable hook 4, which is fixed at the fixing part 31 of the base 3, and is provided with a hook board 41 being mutually assembled with a hook board seat 42, with a pivot ear 411, 421 being provided respectively at connection places between the hook board 41 and the hook board seat 42 that are mutually assembled by transfixing a bolt 43 into the pivot ears 411, 421, an elastic member 44 being provided between the hook board 41 and the hook board seat 42, locking slots 412, 422 being provided respectively on the hook board 41 and the hook board seat 42 to lock two ends of the elastic member 44, and the elastic member 44 being an elastic board or a spring; and a fixing member 5 which can be mutually assembled with the hook board seat 42, with two sides of the hook board seat 42 being provided respectively with a guiding edge 423, two sides of the fixing member 5 being provided respectively with a guiding slot 51, each guiding edge 423 of the hook board seat 42 being mutually assembled with each guiding slot 51 of the fixing member 5, the fixing member 5 being provided with a positioning bump 52, and the hook board seat 42 being provided with a positioning flange 424.

Referring to FIGS. 4, 6, 7, and 8, it shows an exploded view, a first schematic view of an operation, a second schematic view of an operation, and a third schematic view of an operation, of a preferred embodiment of the present invention. When the aforementioned parts are operating and if the hook 2 is not used, as the elastic member 44 is provided between the hook board 41 and the hook board seat 42, and the hook board 41 and the hook board seat 42 are provided respectively with the locking slots 412, 422 for locking the two ends of the elastic member 44, by a curved arc of the elastic member 44 and a design of being locked into the two locking slots 412, 422, the elastic member 44 will be expanded, so as to open the hook board 41 of the movable hook 4. On the other hand, when the hook board 41 of the movable hook 4 is collided by an external force, by an operation of the elastic member 44, a force of the elastic member 44 will break through a threshold to operate the hook board 41 to be ejected back rapidly, and to be exactly emplaced in the hook board slot 32 of the base 3; therefore, when the hook 2 is collided, the hook board 41 can be ejected back rapidly, thereby forming this kind of hidden-type and collision-proofed hook 2.

Referring to FIGS. 4, 9, 10, 11, and 12, it shows an exploded view, a first schematic view of installation, a second schematic view of installation, a third schematic view of installation, and a fourth schematic view of installation, of a preferred embodiment of the present invention. Two sides of the hook board seat 42 are provided respectively with the guiding edges 423, two sides of the fixing member 5 are provided respectively with the guiding slots 51, each guiding edge 423 of the hook board seat 42 is mutually assembled with each guiding slot 51 of the fixing member 5, the fixing member 5 is provided with the positioning bump 52, and the hook board seat 42 is provided with the positioning flange 424. In installing the hook 2, just by sliding out the fixing member 5 which is slidingly provided at the hook board seat 42, and locking the positioning bump 52 with the positioning flange 424 to prevent the fixing member 5 from sliding out, and then fixing the fixing member 5 on a wall with a screw, the base 3 can slide back and be sheathed. Therefore, just with simple and quick steps, the hook 2 of the present invention can be installed.

Figure 13:
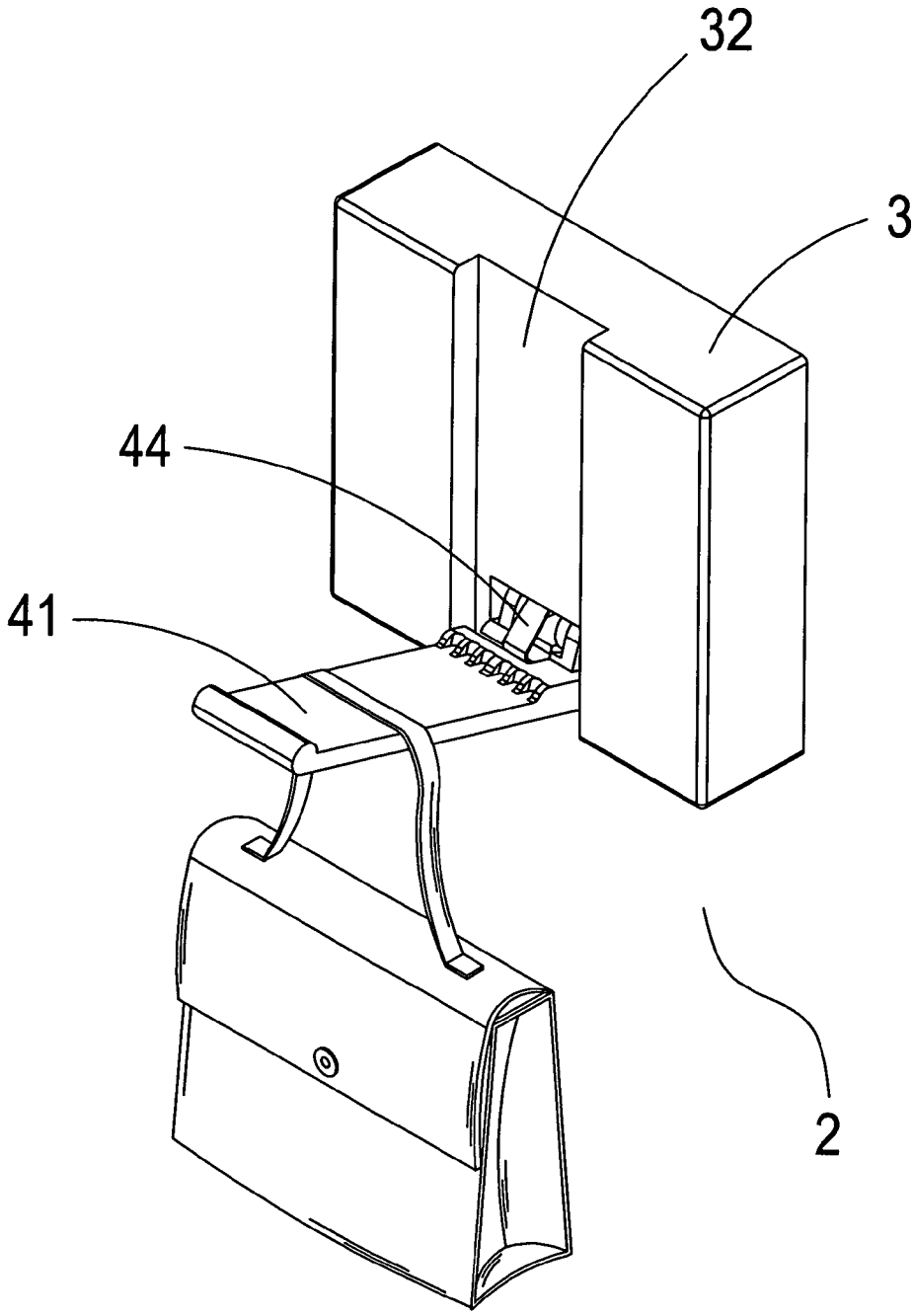
FIG. 13 shows a schematic view of implementation of a preferred embodiment of the present invention.

Referring to FIG. 13, it shows a schematic view of implementation of a preferred embodiment of the present invention. In using the hook 2, the hook board 41 can be opened to hang an object; whereas, when the hook 2 is not used, the hook board 41 can be retracted to the hook board slot 32 of the base 3.

Figure 4:
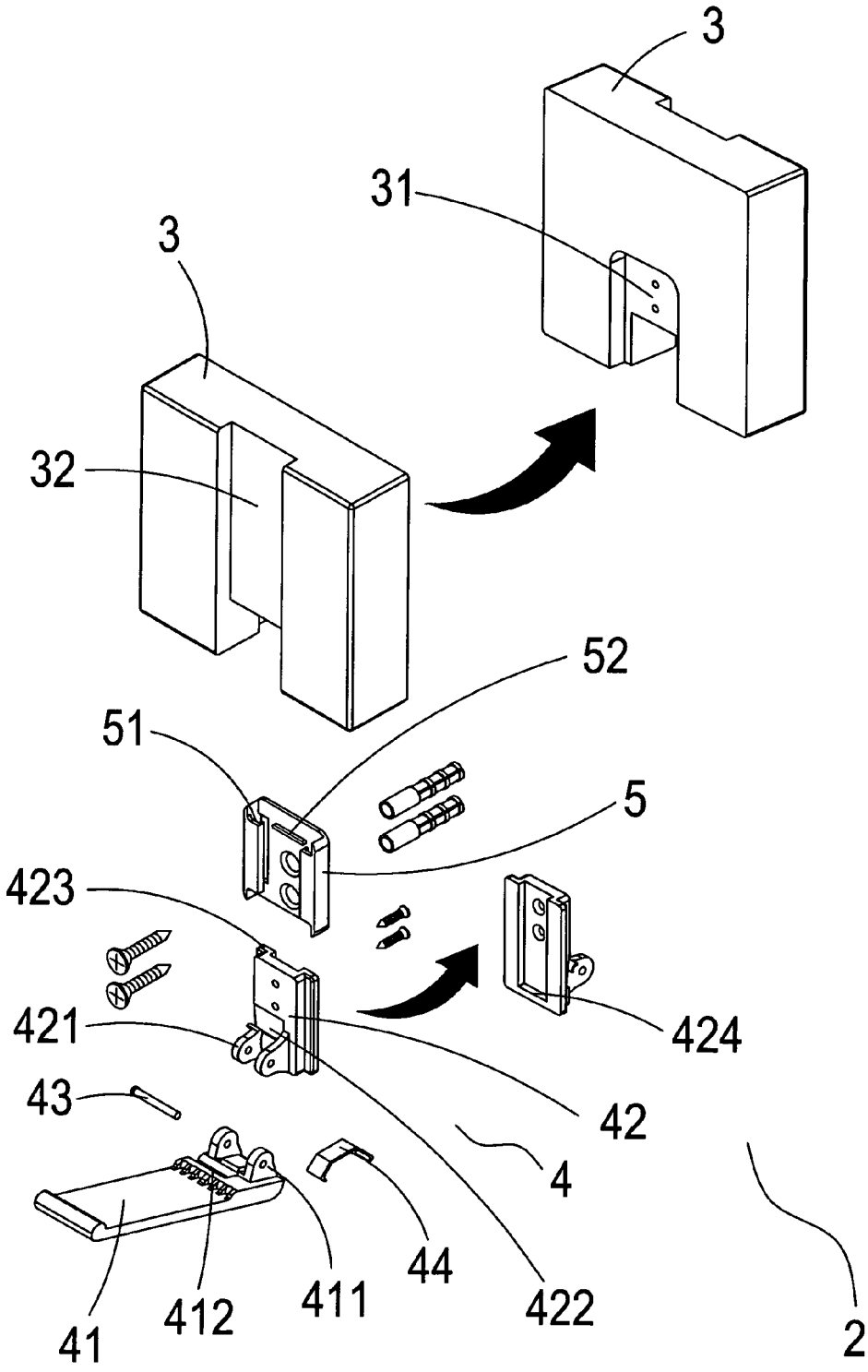
FIG. 4 shows an exploded view of a preferred embodiment of the present invention.
Figure 5:
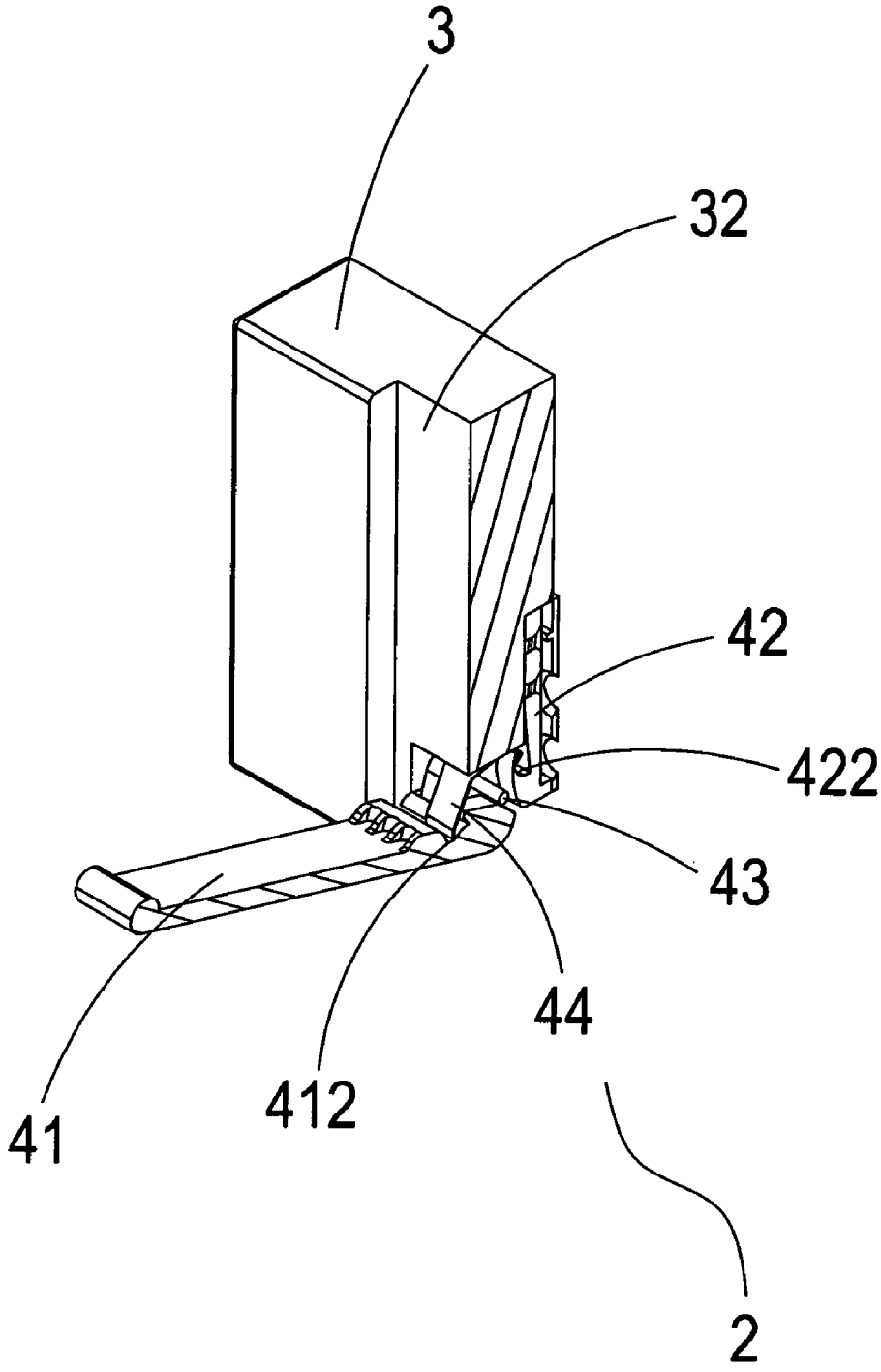
FIG. 5 shows a cutaway view of a preferred embodiment of the present invention.
Figure 6:
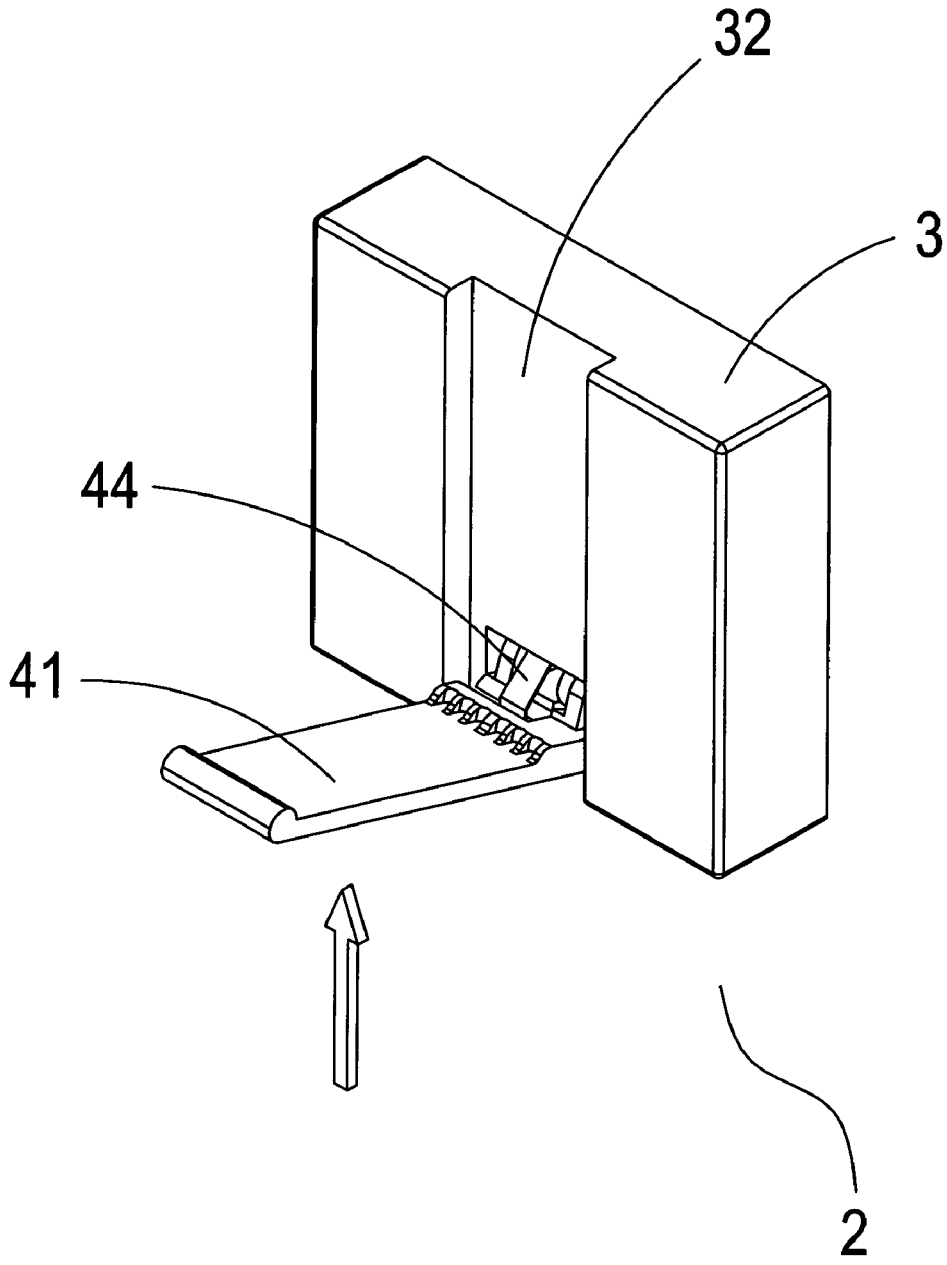
FIG. 6 shows a first schematic view of an operation of a preferred embodiment of the present invention.
Figure 7:
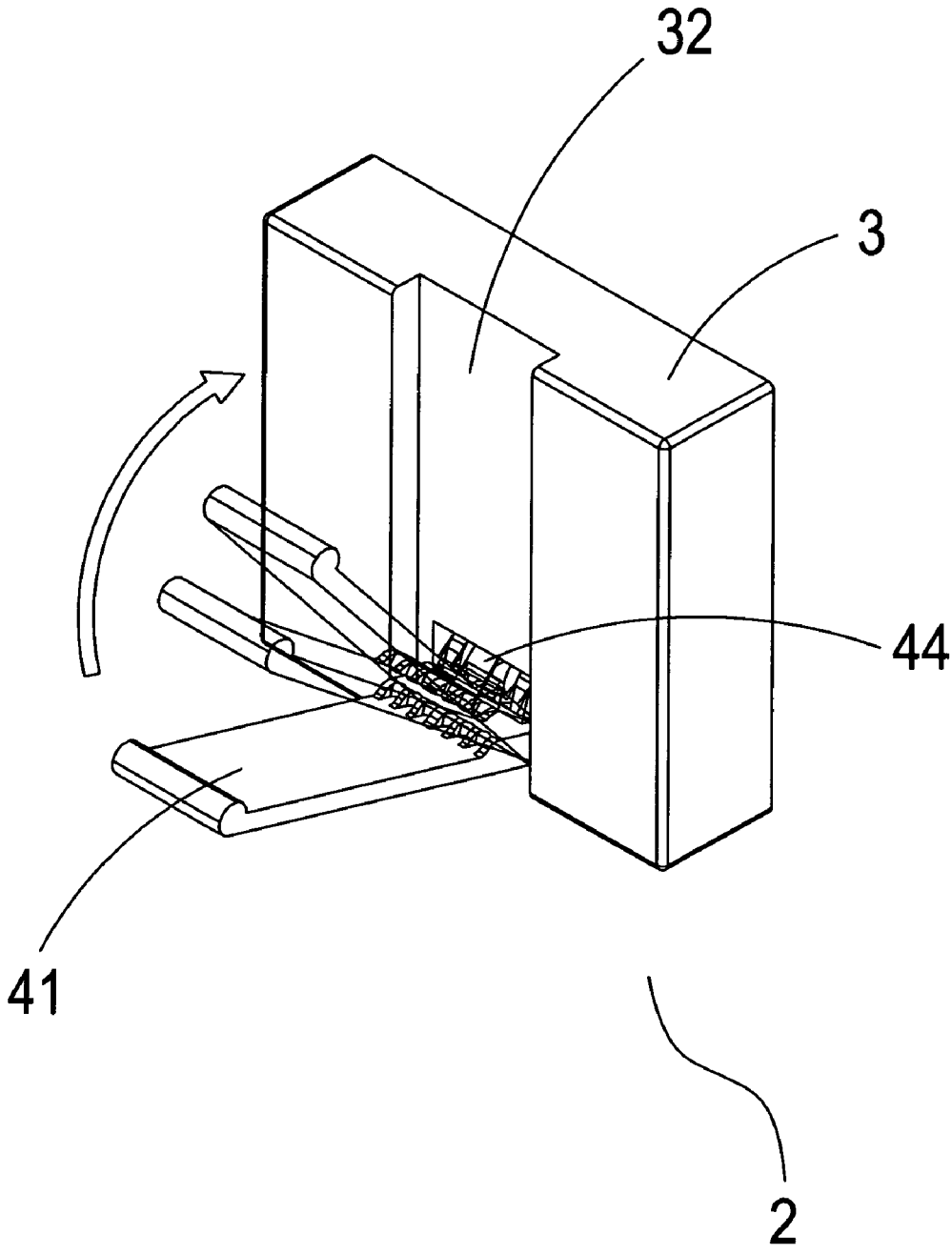
FIG. 7 shows a second schematic view of an operation of a preferred embodiment of the present invention.
Figure 8:
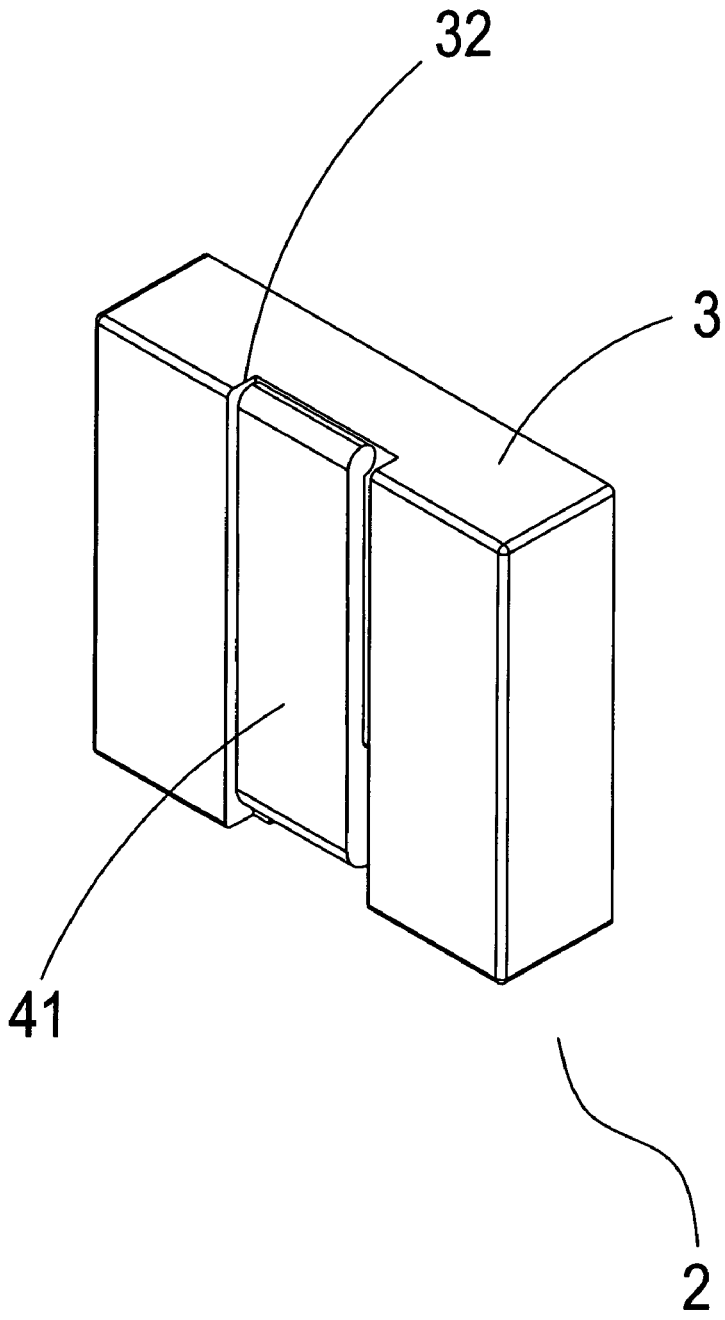
FIG. 8 shows a third schematic view of an operation of a preferred embodiment of the present invention.
Figure 9:
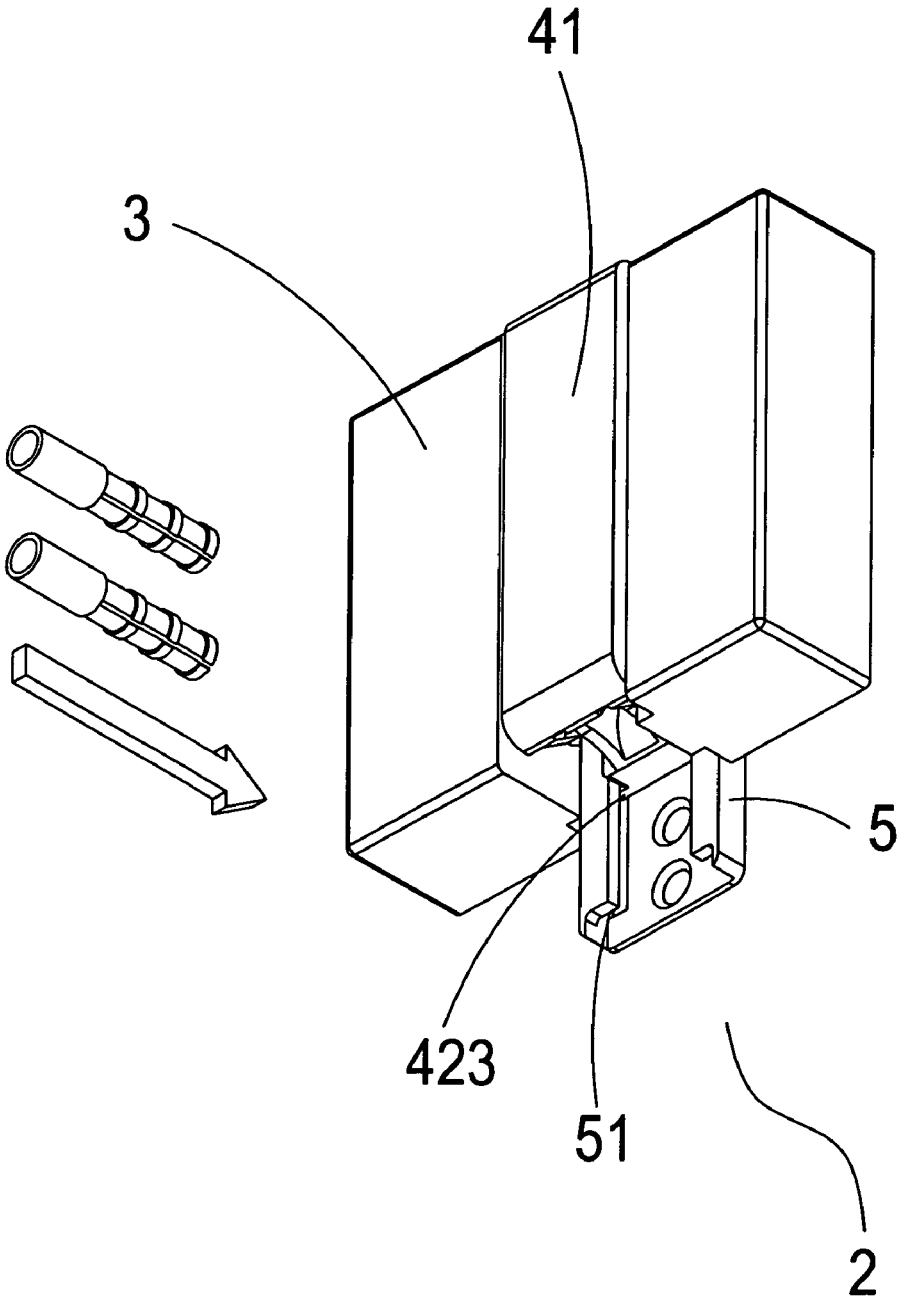
FIG. 9 shows a first schematic view of installation of a preferred embodiment of the present invention.
Figure 10:
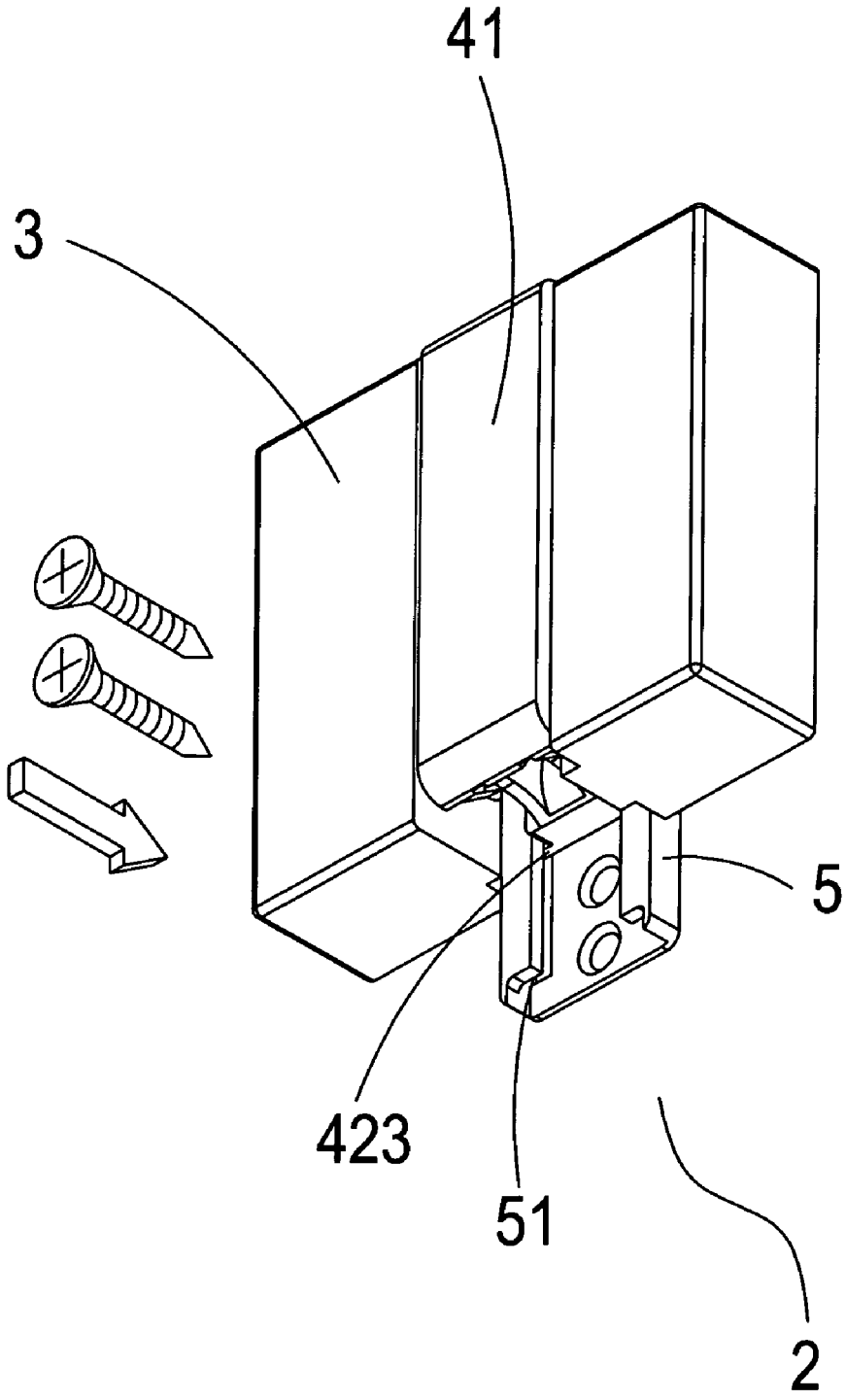
FIG. 10 shows a second schematic view of installation of a preferred embodiment of the present invention.
Figure 11:
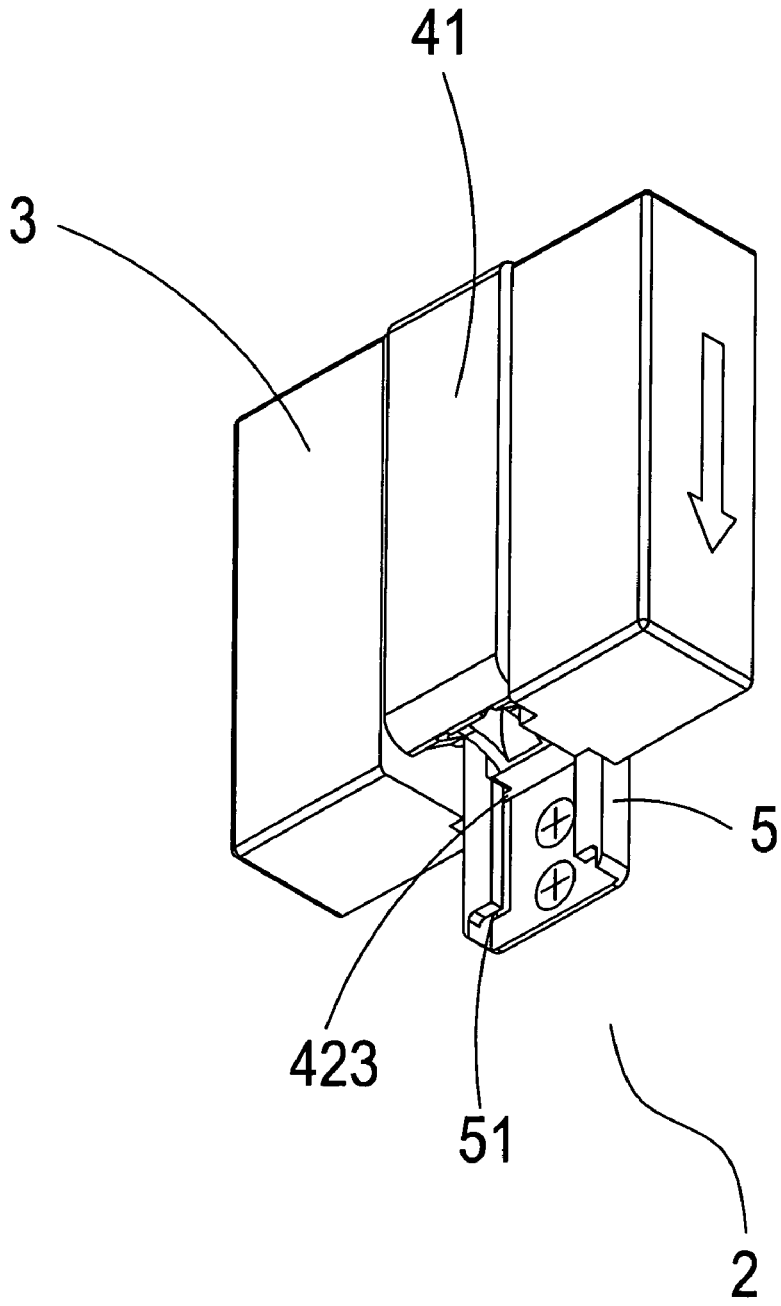
FIG. 11 shows a third schematic view of installation of a preferred embodiment of the present invention.
Figure 12:
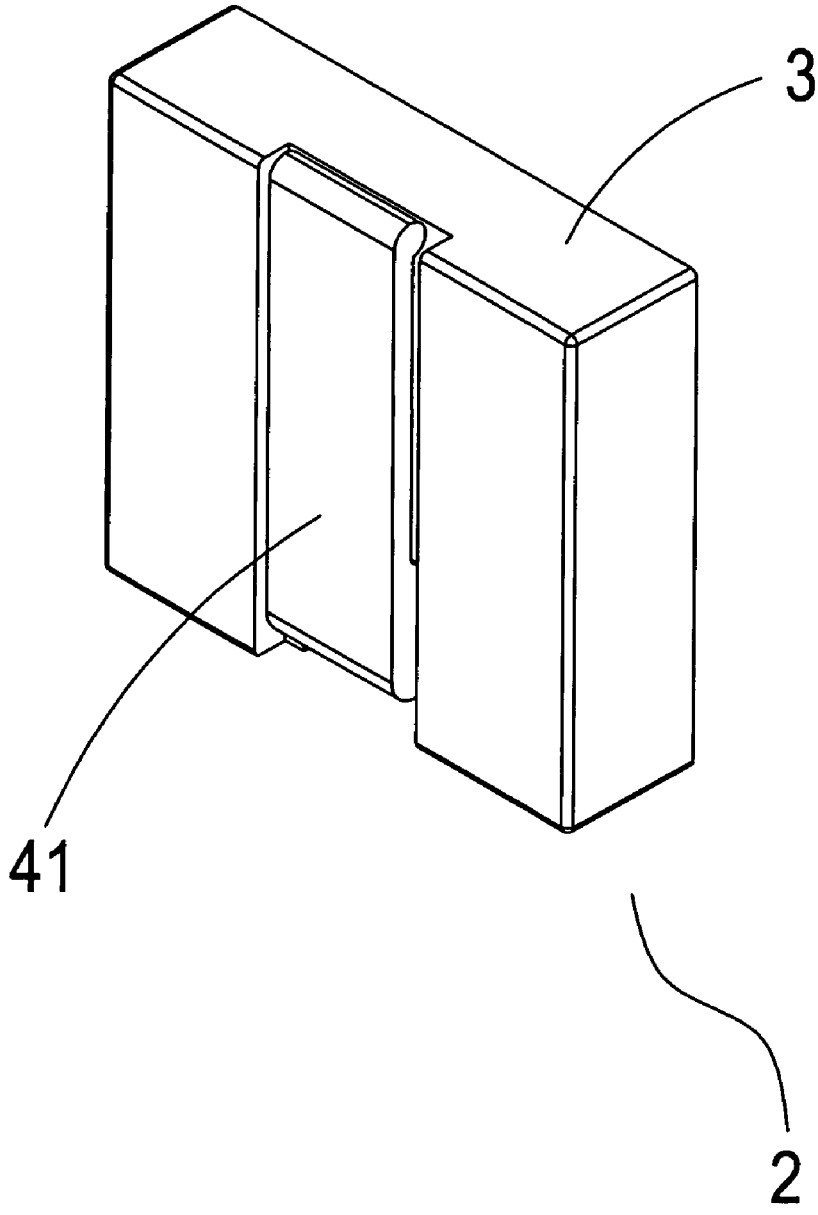
FIG. 12 shows a fourth schematic view of installation of a preferred embodiment of the present invention.
Figure 14:
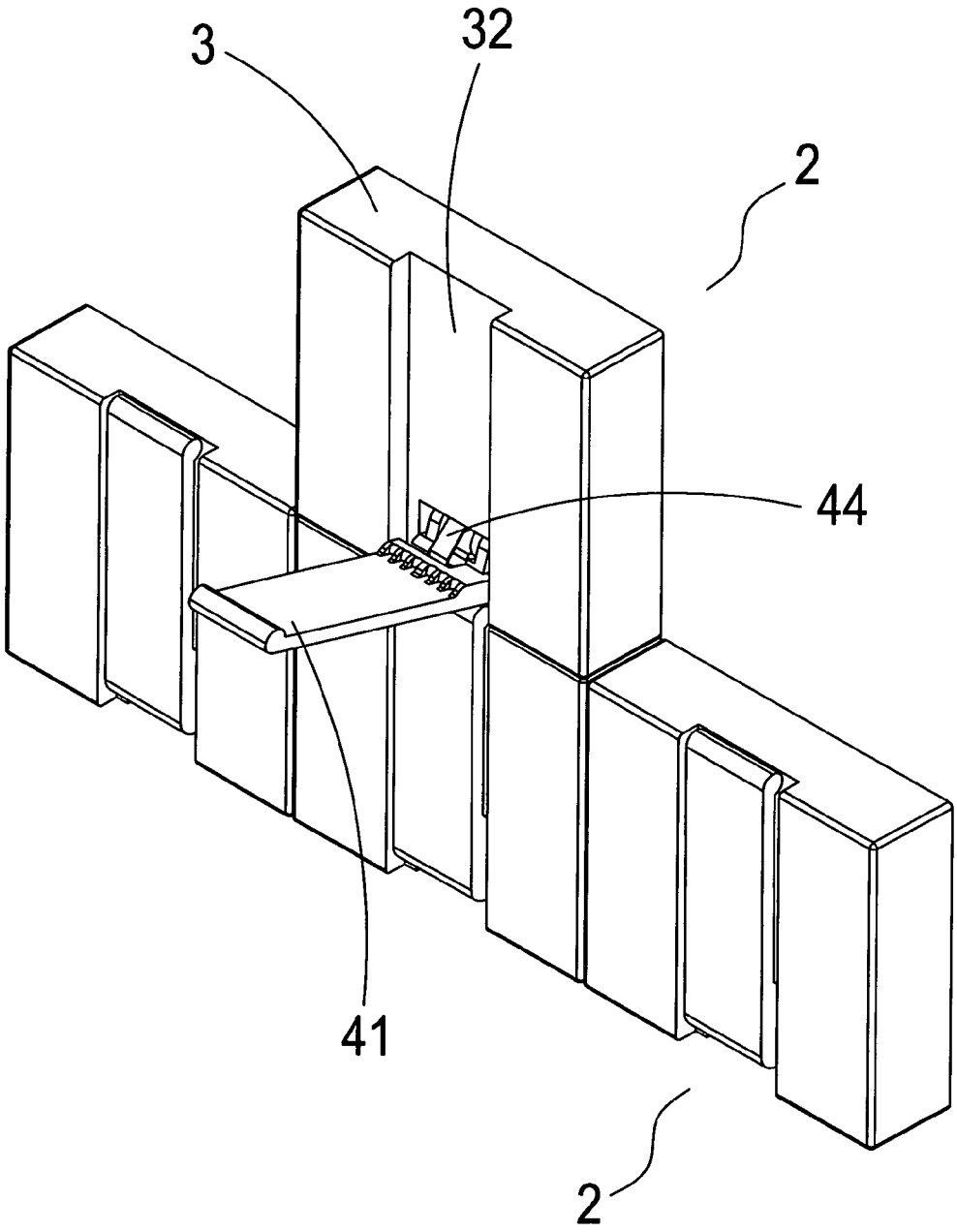
FIG. 14 shows a schematic view of implementation of another embodiment of the present invention.
Figure 15:
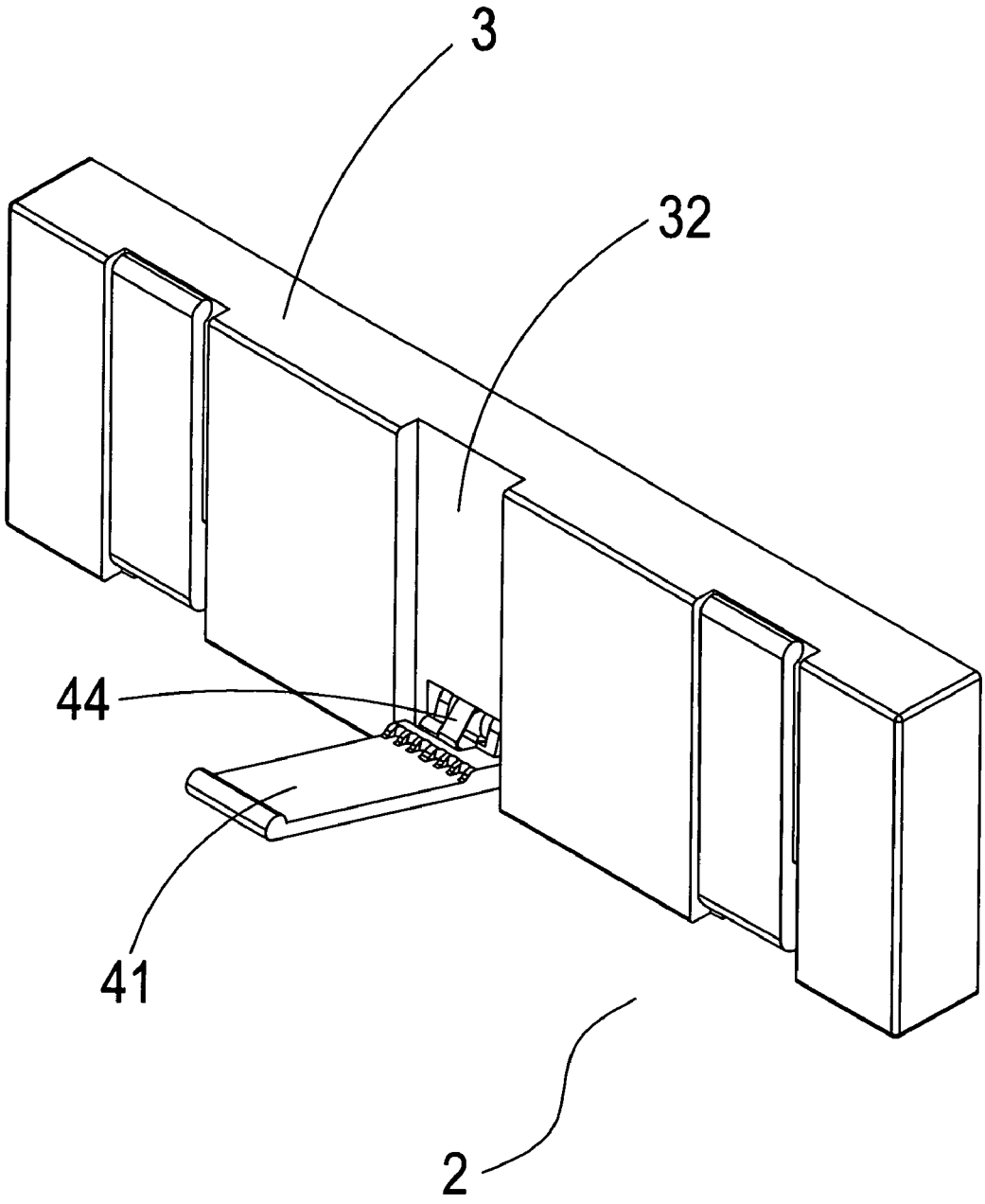
FIG. 15 shows a schematic view of implementation of still another preferred embodiment of the present invention.

Referring to FIGS. 4, 14, and 15, it shows an exploded view of a preferred embodiment, a schematic view of implementation of another preferred embodiment, and a schematic view of implementation of still another preferred embodiment, of the present invention. The base 3 of the present invention can be assembled with other bases 3, to achieve effects of modularization and forming a jigsaw puzzle. In addition, the base 3 of the present invention can be further provided with more than one fixing part 31, and each fixing part 31 is fixed respectively with the movable hook 4.

Referring to all the drawings, the present invention is actually provided with following advantages in comparison with the prior art:

1. The movable hook 4 of the hook 2 is provided with the hook board 41 and the hook board seat 42 that are mutually assembled, and the elastic member 44 is provided between the hook board 41 and the hook board seat 42, with the elastic member 44 being the elastic board or the spring. By the elastic member 44, when the hook 2 is collided, the elastic member 44 will operate the hook board 41 to be ejected back and emplaced in the hook board slot 32 of the base 3, thereby providing the present invention with the advantage of the hidden-type and collision-proofed hook 2.
2. In installing the hook 2, just by sliding out the fixing member 5 which is slidingly provided at the hook board seat 42, and locking the positioning bump 52 with the positioning flange 424 to prevent the fixing member 5 from sliding out, and then fixing the fixing member 5 on the wall with the screw, the base 3 can slide back and be sheathed, so as to accomplish the installation of the hook 2, thereby achieving an advantage of simple and quick installation.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A hook structure comprising a base which is provided with a fixing part; and a movable hook, which is fixed at the fixing part of the base and is provided with a hook board and a hook board seat that are mutually assembled, wherein an elastic member is provided between the hook board and the hook board seat, and a pivot ear is located respectively at connection places between the hook board and the hook board seat, and the hook and the hook board seat are mutually assembled by transfixing a pin into each pivot ear, and the hook board and the hook board seat are provided respectively with locking slots for locking two ends of the elastic member.

2. The hook structure according to claim 1, wherein the elastic member is an elastic board or a spring.

3. The hook structure according to claim 1, wherein the base is provided with a hook board slot for emplacing the hook board.

4. The hook structure according to claim 1, wherein the hook board seat is further assembled with a fixing member.

5. The hook structure according to claim 4, wherein two sides of the hook board seat are provided respectively with a guiding edge and two sides of the fixing member are provided respectively with a guiding slot, with each guiding edge of the hook board seat being mutually assembled with each guiding slot of the fixing member.

6. The hook structure according to claim 4, wherein the fixing member is provided with a positioning bump and the hook board seat is provided with a positioning flange.

7. The hook structure according to claim 1, wherein the base is mutually assembled with other bases to achieve effects of modularization and forming a jigsaw puzzle.

8. The hook structure according to claim 1, wherein the base is further provided with more than one fixing part, and each fixing part is provided respectively with the movable hook.

* * * * *